US005286248A

United States Patent [19]

Dunton

[11] Patent Number: 5,286,248

[45] Date of Patent: Feb. 15, 1994

[54] FLEXIBLE POUCH WITH FOLDED SPOUT

[75] Inventor: David P. Dunton, Mt. Clemens, Mich.

[73] Assignee: Colgate-Palmolive Company, New York, N.Y.

[21] Appl. No.: 873,034

[22] Filed: Oct. 1, 1990

Related U.S. Application Data

[62] Division of Ser. No. 478,883, Feb. 12, 1990, Pat. No. 4,978,232.

[51] Int. Cl.[5] ..... B31B 19/36

[52] U.S. Cl. ..... 493/224; 493/195; 493/210; 493/248

[58] Field of Search ..... 493/194–197, 493/210, 218, 219, 224, 248, 254, 439, 440

[56] References Cited

U.S. PATENT DOCUMENTS 2,283,069 5/1942 Knuetter ..... 493/197

3,147,674 9/1964 Hoeppner ..... 493/210

3,254,374 6/1966 Greiner ..... 493/440

4,913,693 4/1990 Ball ..... 493/346

*Primary Examiner*—Jack Lavinder

*Attorney, Agent, or Firm*—Michael J. McGreal; Robert C. Sullivan

[57] ABSTRACT

A flexible pouch formed from a single sheet of plastic material folded over upon itself along an umbrella like fold assembly to provide the opposed walls of a chamber for storing a product and an optional second sheet to form the bottom of the chamber. The walls and the bottom are sealed along their periphery to form the chamber. The pouch has a self-opening spout formed in part by the fold assembly which expands and springs open when the sealed end of the spout is cut off. The fold assembly not only provides a large spout opening, but also provides a spring force which keeps the spout open so that all the product may be emptied from the chamber.

5 Claims, 2 Drawing Sheets

FLEXIBLE POUCH WITH FOLDED SPOUT

This is a Continuation, of application Ser. No. 07/478,883 filed Feb. 12, 1990, now U.S. Pat. No. 4,978,232.

BACKGROUND OF THE INVENTION

This invention relates generally to a flexible pouch constructed of laminated plastic material used for containing a fluid product and in particular to a flexible pouch having a novel self opening spout arrangement to facilitate pouring of all the product from the pouch. More particularly, this invention relates to a flexible pouch the construction of which makes it useful for refilling other containers.

Conventional flexible pouches having a spout for pouring liquid stored therein are disclosed in U.S. Pat. Nos. 3,171,581, 3,907,164 4,285,376, 4,332,344, 4,491,245, 4,578,813 and Re 24,251. While pouches of this type have become very popular, particularly for environmental considerations, they suffer a common disadvantage that the spout of those pouches has a tendency to close upon itself during the pouring operation which blocks the discharge of the liquid through the spout. As a result it is difficult to empty all the liquid from the pouch.

One attempt to overcome this problem is disclosed in U.S. patent application Ser. No. 327,659 filed on Mar. 23, 1989 and assigned to the same assignee as this application. The proposal set forth in that application represents a substantial improvement over the prior art. In similar fashion the invention as set forth in this application and described below provides a novel self opening spout design having an enlarged pouring opening which stays open as the liquid is emptied from the pouch.

SUMMARY OF THE INVENTION

The primary object of this invention resides in the provision of a flexible pouch the walls of which are formed from a single sheet of material folded back upon itself and having a novel self opening spout that opens quickly and remains open as all the liquid is poured from the pouch. The bottom of the pouch can be formed from a second film. The peripheral edges of the sidewalls and the bottom are sealed to form the pouch.

Another object of the invention resides in the provision of the above pouch wherein a portion of the spout includes a fold assembly which provides a resilient spring force for opening the spout when its sealed edge is cut. The spring force also keeps the spout open so that all the liquid in the pouch may be emptied therefrom.

A further object of the invention resides in the provision of a pouch having the above described novel self-opening spout wherein the upper portion of the spout includes an umbrella like fold assembly which produces an opening spring force when the sealed edge of the spout is cut off.

Another object of the invention is to provide the above described pouch which includes a recess immediately below the spout, the recess facilitating the pouring of the liquid through the spout into containers having various neck diameters.

These and other objects and advantages will become apparent as the described proceeds in connection with the accompanying drawings.

DETAILED DESCRIPTION OF THE INVENTION

Figure 1:
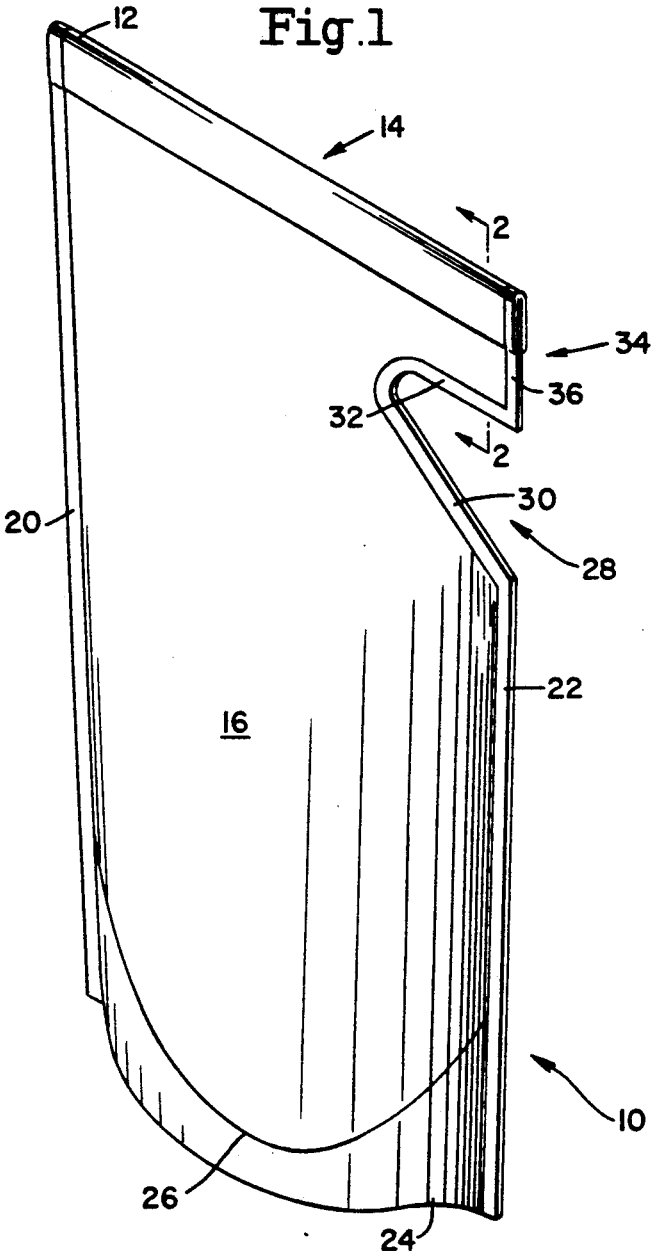
FIG. 1 is a side perspective view of a flexible pouch incorporating the novel folded pouring spout of the invention.

Referring now to the drawings, the sidewalls of pouch 10 are formed from a single sheet of flexible plastic material folded over at its top edge 12 via fold assembly 14 to provide opposing front and back walls 16 and 18. The bottom wall is preferably provided by a second sheet of flexible plastic material. The sidewalls and the bottom wall are sealed together peripherally along their side edges 20 and 22 and bottom edge 24 to form a closed inner chamber. The bottom edge of the pouch may be gussetted along contour 26 to enable the pouch to stand upright when the inner chamber is filled with liquid. Although it is preferred to have a separate bottom wall so as to form a gusseted container, the sidewalls can be sealed along their full periphery in order to form the pouch. This is the case since the primary distinctive feature of the present pouches resides in the contruction of the pouring spout and the method of producing this pouring spout.

The wall materials are preferably transparent or translucent plastic of a type which will not react with the ingredients in the liquid to be stored in the pouch chamber. The peripheral edges of the material are bonded together by heat sealing, dielectric sealing, sonic welding, adhesive, or other suitable means to form the closed inner chamber of the pouch.

The side edge 22 includes a recessed section 28 having an upwardly and inwardly inclined sealed edge 30 terminating in a lateral sealed edge 32 spaced below top edge 12 so that the upper portions of walls 16 and 18 between top edge 12 and edge 32 define a pouring spout 34 at a corner of the pouch.

Figure 4:
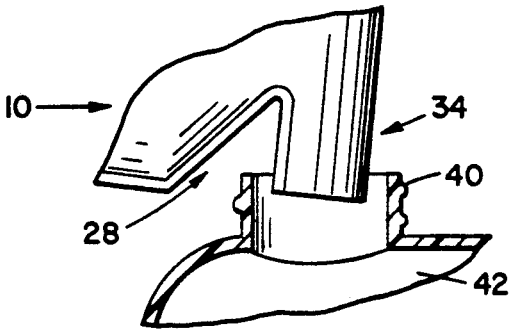
FIG. 4 is a fragmentary view showing the pouch and its spout in the pouring position with respect to the neck of a container.
Figure 5:
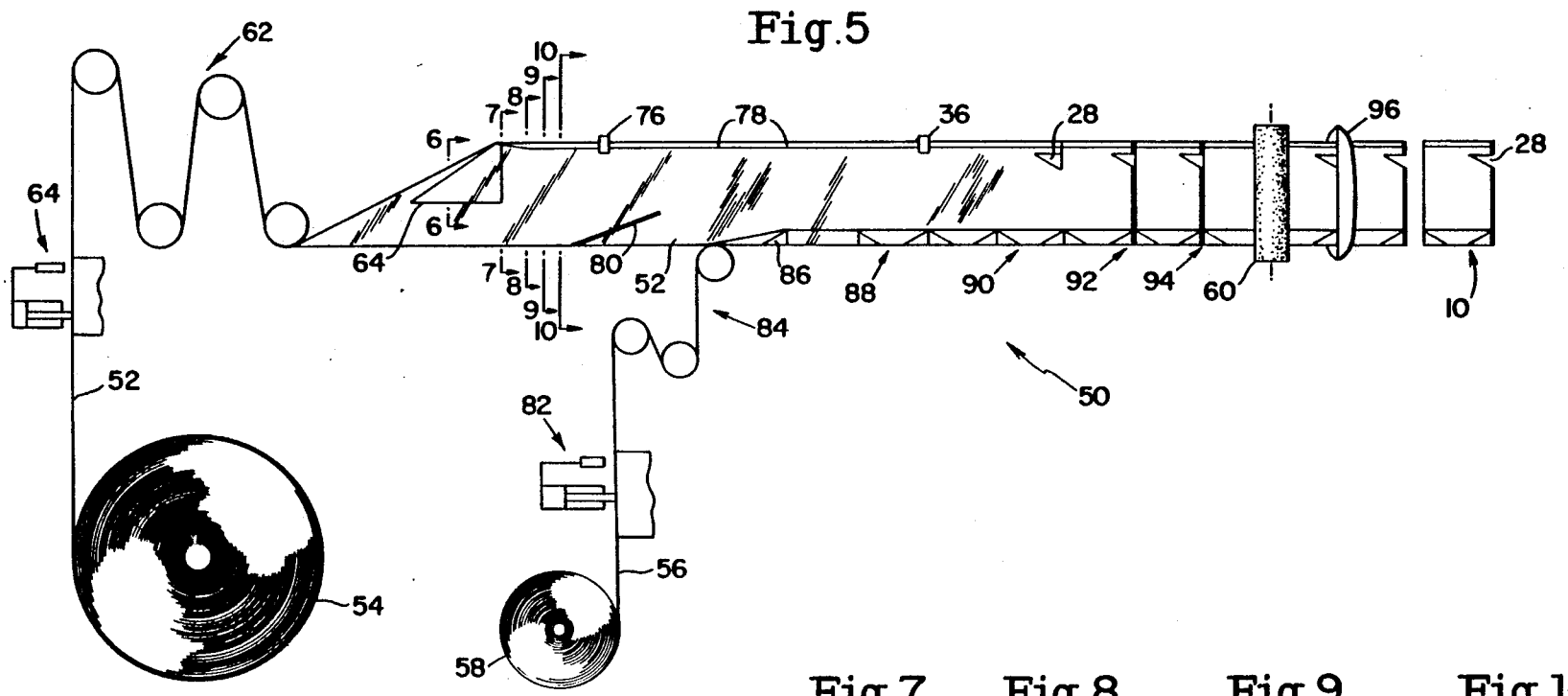
FIG. 5 is a schematic illustration of a manufacturing process and equipment by which the pouch illustrated in FIGS. 1-3 may be produced.
Figure 10:
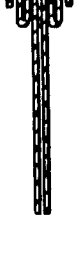
FIG. 10 is a fragmentary sectional view taken along line 10—10 of FIG. 5.
Figure 9:
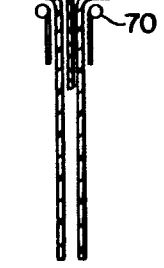
FIG. 9 is a fragmentary sectional view taken along line 9—9 of FIG. 5.
Figure 8:
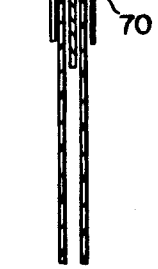
FIG. 8 is a fragmentary sectional view taken along line 8—8 of FIG. 5.
Figure 7:
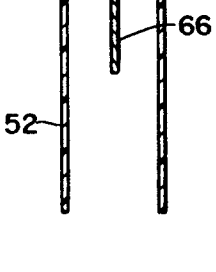
FIG. 7 is a fragmentary sectional view taken along line 7—7 of FIG. 5.
Figure 6:
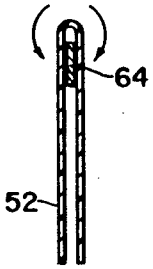
FIG. 6 is a fragmentary sectional view taken along line 6—6 of FIG. 5.

To pour the liquid from the pouch the sealed edge 36 of spout 34 is cut off to form opening 38 and the spout is inserted into the open neck 40 of a rigid container 42 (FIG. 4). Recess 28 conveniently accommodates container necks of different diameters and facilitates pouring of all the liquid from the pouch into the container.

As discussed initially hereinabove, many prior spout designs have experienced a problem with blockage during the pouring process because the opening of the spout is too small and the walls of the spout tend to close upon themselves. The novel self opening spout 34 shown in the drawings overcomes those problems and enables all the liquid to be poured from the pouch.

Figure 2:
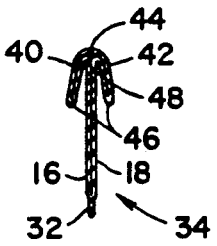
FIG. 2 is a fragmentary sectional view taken along line 2—2 of FIG. 1.

The fold assembly 14 at top edge 12 is formed by doubling upper portions 40 and 42 of walls 16 and 18 outwardly and under back upon themselves along fold lines 44, 46 and 48 in umbrella type fashion (FIG. 2). Fold assembly 14 forms the upper part of spout 34. Wall portions 40 and 42 are of substantially uniform depth and extend transversely across the total width of pouch 10. As shown in FIG. 1 the sealed side edge 20 extends to the top of the pouch and seals the back edge of fold assembly 14. The front sealed edge 36 of spout 34 extends to the top and seals the front of the fold assembly.

Figure 3:
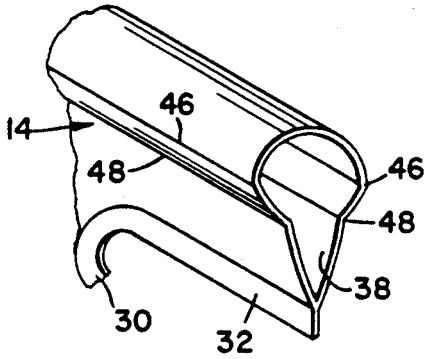
FIG. 3 is a fragmentary side perspective view of the spout in its open pouring condition.

To empty the liquid from pouch 10 the front sealed edge 36 is cut off causing the spout to open quickly to the position of FIG. 3 under the resilient spring force provided by folded portions 40 and 42. Because of the excess fold material at the top of the spout opening 38 this spout opening is large and the spring loaded fold assembly prevents the opening from closing as liquid is poured from the pouch.

The pouch illustrated in FIGS. 1–3 may be manufactured using bag making apparatus 50 shown schematically in FIGS. 5–10. The main body of pouch 10 is formed from a continuous main web 52 of plastic material unrolled from a coil 54. The gusset 26 is formed from a second web 56 of plastic material unrolled from a coil 58. Web 56 is narrower in width than web 52. A drive roller assembly 60 intermittently advances the webs through the various operational stations of apparatus 50.

Web 52 is advanced from coil 54 to a tension roller assembly 62 which keeps the web taught so that an air actuated male/female die punch assembly 64 can create top side seal holes in the web by which the upper side edge of the pouch may be subsequently tacked. After web 52 leaves the last roller of assembly 62, it is drawn over a forming plow 64 which folds the web in half (FIG. 6) into an inverted "U" shape open at the bottom. Plow 64 enlarges into a T-section 66 (FIG. 7) to form a flat 68 on the top of the web. The web is then advanced into another side plow assembly 70 (FIG. 8) which wraps the web around the T-mandrel. Next the web passes through a top plow 72 (FIG. 9) which flattens the web against the T-mandrel to provide an excess of material. The T-mandrel tapers down into a straight mandrel, while plow 72 tapers down into an inverted U shaped channel configuration (FIG. 10) so as to form the umbrella fold of FIG. 2. Immediately upon leaving channel 74 a heat sealing bar 76 tacks the fold assembly 14 at predetermined space intervals 78 to ensure that the assembly does not unfold.

The bottom edges of folded web 52 are spread open by a spreader bar assembly 80 to allow for the introduction and positioning of the bottom gusset. The gusset web 56 is passed through a die punch assembly 82, a tension roller assembly 84, and then over a folding plow 86 by which it is folded in half in a U-shape and positioned vertically between the open bottom edges of folded web 52. The bottom gusset 26 is heat sealed at seal station 88 at the same time that edge 36 of the spout is sealed. In the next station 90 the bottom gusset is cooled and the recess area 28 is die cut. The side edges 20 and 22 are then sealed and cooled at stations 92 and 94, and finally the web is cut at station 96 into individual pouches. Each pouch remains open at recess 28 to permit subsequent filling.

The process and apparatus of FIGS. 5 to 10 are related to other processes and apparatus for producing pouches. However, the novel design of plow assemblies 64, 66, 70, 72, and 74 which cooperate to form the umbrella-like fold assembly 14 along the top of the pouch is a distinct advance in the art. This also provides for a positive pouring spout.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method for producing flexible pouches comprising passing continuously a first web of a flexible plastic material over a shaping means to form the plastic material into an inverted U-shape having a rounded loop section, forming the loop section into an essentially flat section by continuously passing the web over the shaping means, the folding a portion of said flat section of material of the inverted U-shape outwardly along exterior surfaces of the plastic material of each leg of the inverted U-shaped plastic material to form a spout in the top of the flexible pouch and then sealing edges of said plastic material to form a pouch.

2. A method for producing flexible pouches as in claim 1, wherein the portion of the essentially flat section folded outwardly along each leg of the inverted U-shaped plastic material is sealed so as to maintain said folded essentially flat section in said folded orientation.

3. A method for producing flexible pouches as in claim 1, wherein after the essentially flat section of said flexible plastic material has been formed at one edge of said first web, a second web of a flexible plastic material is fed to a shaping means to form a U-shape and passed into contact with an inner surface of the inverted U-shape flexible plastic material.

4. A method for producing flexible pouches as in claim 3, wherein after said inverted U-shaped flexible plastic material is contacted with said U-shaped flexible plastic material, the U-shape material is sealed to the inverted U-shape material along sidewall edges and bottom edges.

5. A method for producing flexible pouches as in claim 4, wherein after said edges are sealed, the pouch is severed along at least one edge.

* * * * *